US006810917B2

(12) United States Patent
Stone

(10) Patent No.: US 6,810,917 B2
(45) Date of Patent: Nov. 2, 2004

(54) FORMING FABRIC WITH MACHINE SIDE LAYER WEFT BINDER YARNS

(75) Inventor: Richard Stone, Carleton Place (CA)

(73) Assignee: AstenJohnson, Inc., Kanata (CA)

( * ) Notice: Subject to any disclaimer, the term of this patent is extended or adjusted under 35 U.S.C. 154(b) by 246 days.

(21) Appl. No.: 10/204,453

(22) PCT Filed: Mar. 6, 2001

(86) PCT No.: PCT/CA01/00275

§ 371 (c)(1),
(2), (4) Date: Aug. 30, 2002

(87) PCT Pub. No.: WO01/66856

PCT Pub. Date: Sep. 13, 2001

(65) Prior Publication Data

US 2003/0024590 A1 Feb. 6, 2003

(30) Foreign Application Priority Data

Mar. 6, 2000 (GB) ..... 0005344

(51) Int. Cl.[7] ..... D03D 23/00
(52) U.S. Cl. ..... 139/383 A; 162/903; 442/203
(58) Field of Search ..... 139/383 R, 383 A; 442/203; 162/903

(56) References Cited

U.S. PATENT DOCUMENTS

| | | | | |
|---|---|---|---|---|
| 4,554,953 A | | 11/1985 | Borel | |
| 5,152,326 A | | 10/1992 | Vohringer | |
| 5,219,004 A | | 6/1993 | Chiu | |
| 5,518,042 A | | 5/1996 | Wilson | |
| 5,520,225 A | | 5/1996 | Quigley et al. | |
| 5,542,455 A | | 8/1996 | Ostermayer et al. | |
| 5,544,678 A | | 8/1996 | Barrett | |
| 5,564,475 A | | 10/1996 | Wright | |
| 5,641,001 A | | 6/1997 | Wilson | |
| 5,709,250 A | | 1/1998 | Ward | |
| 5,826,627 A | | 10/1998 | Seabrook et al. | |
| 5,937,914 A | | 8/1999 | Wilson | |
| 6,202,705 B1 | * | 3/2001 | Johnson et al. | 139/383 A |
| 6,240,973 B1 | * | 6/2001 | Stone et al. | 139/383 A |
| 6,244,306 B1 | * | 6/2001 | Troughton | 139/383 A |
| 6,253,796 B1 | * | 7/2001 | Wilson et al. | 139/383 A |
| 6,334,467 B1 | * | 1/2002 | Barrett et al. | 139/383 A |
| 6,354,335 B1 | * | 3/2002 | Taipale et al. | 139/383 A |
| 6,413,377 B1 | * | 7/2002 | Wright | 139/383 A |
| 6,546,964 B1 | * | 4/2003 | Westerkamp | 139/383 A |
| 6,581,645 B1 | * | 6/2003 | Johnson et al. | 139/383 A |

FOREIGN PATENT DOCUMENTS

| | | |
|---|---|---|
| DE | 42 29 828 | 3/1994 |
| EP | 0 794 283 | 9/1997 |
| WO | WO 99/61698 | 12/1999 |

* cited by examiner

*Primary Examiner*—John J. Calvert
*Assistant Examiner*—Robert H Muromoto
(74) *Attorney, Agent, or Firm*—Robert A. Wilkes; Shapiro Cohen

(57) ABSTRACT

A flat woven papermaker's forming fabric having a paper side layer and a machine side layer interconnected by pairs of machine side layer weft binder yarns. Each of the binder yarn pair members in sequence interlaces with a portion of the machine side layer warp yarns in segments of the weft yarn path so as to complete an unbroken weft path in the machine side layer weave pattern, and to provide an internal machine side layer float. Each of the binder yarn pair floats interweaves with a paper side layer warp yarn so as to bind the paper and machine side layers together. The location of the internal floats in each layer determines the available interweaving locations, not all of which need be used. A wider choice of possible paper and machine side layer weave design combinations is thus made available in forming fabrics, thereby allowing for a better match between the forming fabric and the paper maker's requirements.

14 Claims, 16 Drawing Sheets

FORMING FABRIC WITH MACHINE SIDE LAYER WEFT BINDER YARNS

FIELD OF THE INVENTION

The present invention relates to flat woven papermaker's forming fabrics having a paper side layer and a machine side layer interconnected by machine side layer weft binder yarn pairs. Within the overall fabric weave pattern, the number of machine side layer weft yarns between each pair of weft binder yarns can zero, one, two or three.

BACKGROUND OF THE INVENTION.

Flat woven papermaker's forming fabrics in which paper side layer weft binder yarn pairs are used to interconnect the weave structures of the paper and machine side layers are well known. Various arrangements have been described, for example by Wilson, U.S. Pat. No. 5,518,042; Vohringer, U.S. Pat. No. 5,152,326; Quigley et al., U.S. Pat. No. 5,520,225; Ostermayer et al., U.S. Pat. No. 5,542,455; Wright, U.S. Pat. No. 5,564,475; Wilson, U.S. Pat. No. 5,641,001; Ward, U.S. Pat. No. 5,709,250; Seabrook et al., U.S. Pat. No. 5,826,627; and Wilson, U.S. Pat. No. 5,937,914. Many others are known. None of these references discuss in any detail the impact of the use of weft binder pairs on the properties of the machine side layer.

As used herein, the following terms have the following meanings.

The term "weft binder yarn" refers to each yarn of a pair of yarns which together occupy a single unbroken weft path in the machine side layer, and which separately interweave with a paper side layer warp yarn.

The term "interweave" refers to a locus at which a yarn forms at least one knuckle with another yarn in the paper side layer.

The term "interlace" refers to a locus at which a yarn forms at least one knuckle with another yarn in the machine side layer.

The term "segment" refers to a locus at which a weft binder yarn interlaces with at least one machine side layer warp within the machine side layer.

The term "float" refers to that portion of a yarn which passes over, or under, a group of other yarns in the same layer of the fabric without interweaving or interlacing with them. The associated term "float length" refers to the length of a float, expressed as a number indicating the number of yarns passed over, or under, as appropriate. A float can be exposed on the machine side or paper side of each of the paper side layer and the machine side layer. The term "internal float" thus refers to a float exposed between the two layers, either on the machine side of the paper side layer, or on the paper side of the machine side layer.

The terms "symmetry" and "asymmetry", and the associated terms "symmetrical" and "asymmetrical", refer to the shape of the path occupied by a weft binder yarn as it exits the machine side layer, interweaves with a paper side layer warp, and enters the machine side layer. The path is symmetrical when the interweaving point is located substantially at the middle of the path, and the number of warp yarns between the exit point and the interweaving point is equal to, or nearly equal to, the number of yarns between the interweaving point and the entry point.

The notation such as 3/2 in reference to a fabric design refers to the number of warp, or machine direction yarns, over or under which a weft, or cross machine direction yarn, floats within the weave pattern. Thus 3/2 means that a weft yarn floats over three warp yarns and then under two warp yarns within the weave pattern.

The prior art, as exemplified above, seems to have limited the designs of forming fabrics of this type to those in which weft binder yarn pairs are used to provide an intrinsic component of the paper side layer weave design, and to enhance the paper side layer formation characteristics, as in the Wilson and Seabrook patents. The prior art designs also created limitations which were generally believed to be necessary to maximise fabric stability, reduce or even eliminate sleaziness (the movement of one of the two layers relative to the other) and fabric delamination (the catastrophic separation of the two layers caused by both internal and external abrasion of the weft binder yarns). The prior art generally served to restrict the number of paper side layer and machine side layer weave designs that could be combined together. It is thus apparent that a great deal of experimental effort had to be expended in order to find compatible combinations of paper and machine side layer weave designs capable of interconnection by means of weft binder yarns, due to the restrictive criteria noted above.

BRIEF SUMMARY OF THE INVENTION

This invention is based on the discovery that machine side layer weft yarns can be successfully used as weft binder yarn pairs in fabrics of this type. The machine side layer weft binder yarn paths can also be chosen to minimise internal stresses introduced during weaving the two layer fabric. Further, their use also appears to provide significantly greater flexibility in the choice of compatible paper side layer and machine side layer weave designs. In this invention, within the weave pattern repeat, there is either zero, one, two or three machine side layer weft yarns between each pair of machine side layer weft binder yarns. It is thus possible to match the locations of the internal floats of the weft binder yarns within the machine side layer pattern repeat to the desired paper side layer interweaving locations, so that they are located more or less at the midpoints of the paper side layer internal warp floats. The paper side layer weave design is selected so as to be appropriate for the paper product to be made using the forming fabric. It is also now possible to select the machine side layer weave design to optimise machine side layer properties, and then to select interweaving points that are located more or less at the midpoints of the internal floats of the weft binder yarns. It has also been discovered that not all of the available interweaving locations have to be used: it is possible to leave some of them out within the forming fabric weave pattern repeat.

In the fabrics of this invention, the paper side layer internal warp float should be as long as possible, with the interweaving point located as close as possible to the middle of this float. The path occupied by the machine side layer weft binder yarn internal float should be as symmetrical as possible about the interweaving point. Further, in the fabrics according to this invention all of the machine side layer weft yarns are substantially the same size, and therefore although at least some, if not all, are doubled as weft binder yarn pairs, all of them contribute to the properties of the machine side layer of the fabric. The paper side layer weft yarns will frequently be smaller than the machine side layer weft yarns, and may also be larger.

The interweaving locations of the paper side layer and machine side layer floats should be chosen with some care. The limitation on both of these floats appears to be that each should be as long as is reasonably possible. In its path in between the two layers, the machine side layer weft float has essentially a "V" shape: as the float length increases, the V is flattened reducing the out of plane stresses. If the V shaped path is not symmetrical, or the float is relatively short, any stresses imposed on the forming fabric are increased at the shorter end of the float. The upper limits on these two float lengths cannot be directly determined.

STATEMENT OF THE INVENTION

The present invention seeks to provide a papermaker's forming fabric comprising in combination a paper side layer including a first set of warp and weft yarns interwoven according to a first pattern which provides for internal floats of the paper side layer warp yarns, a machine side layer including a second set of warp and weft yarns, in which the weft yarns include weft binder yarn pairs, interwoven according to a second pattern which provides for internal floats of the machine side layer weft binder yarns, wherein within the fabric weave pattern repeat:

(i) the weft binder yarn pairs together occupy successive segments of an unbroken weft path within the machine side layer;

(ii) at least some of the machine side layer weft binder yarn internal floats interweave with paper side layer internal warp yarn floats;

(iii) there is zero, one, two or three machine side layer weft yarns between each pair of binder yarns; and (iv) the paper side layer warp yarn internal float length is at least 2.

Preferably, within the weave pattern repeat, the number of machine side layer weft yarns between each pair of weft binder yarns is constant. Alternatively, within the weave pattern repeat, the number of machine side layer weft yarns between each pair of weft binder yarns is not constant.

Preferably, the segments of the weft binder yarn unbroken weft path occupied by each member in succession are the same length. Alternatively, the segments of the weft binder yarn unbroken weft path occupied by each member in succession are not the same length.

Preferably, each member of a weft binder yarn pair interweaves at or near to the midpoint of an internal paper side layer warp yarn float.

Preferably, within the pattern repeat, the majority of the paper side layer warp yarns interweave once with a machine side layer weft binder yarn.

Preferably, the path occupied by each weft binder yarn, as it passes from interlacing with the machine side layer warp yarns in a segment of the machine side layer weft yarn path to interweave with a paper side layer warp yarn internal float and returns to interlace with the machine side layer warp yarns in another segment of the machine side layer weft yarn path, is more or less symmetrical about the interweaving point.

Preferably, the paper side layer warp yarn internal float length is at least three. Most preferably, the paper side layer warp yarn internal float length is four or more.

Preferably, the paper side layer is woven according to a weave design chosen from the group consisting of: a 2/1 twill, a 2/1 broken twill, a 2/1 satin, a 2/2 basket weave, a 2/2 twill, a 3/1 twill, a 3/1 broken twill, a 3/1 satin, a 3/2 twill, a 3/2 satin, a 4/1 twill, a 4/1 broken twill, a 4/1 satin, a 5/1 twill, a 5/1 broken twill, and a 5/1 satin.

Preferably, the machine side layer is woven to a weave design chosen from the group consisting of: a plain weave, a 2/1 twill, a 2/1 broken twill, a 2/1 satin, a 2/2 basket weave, a 3/1 twill, a 3/1 broken twill, a 3/1 satin, a 3/2 twill, a 3/2 satin, a 4/1 twill, a 4/1 broken twill, a 4/1 satin, a 5/1 twill, a 5/1 broken twill, a 5/1 satin, a 6/1/ twill, a 6/1 broken twill, a 6/1 satin, and an N×2N design as disclosed by Barrett in U.S. Pat. No. 5,544,678.

Preferably, the ratio of the number of paper side layer weft yarns to the number of machine side layer weft yarns is chosen from the group consisting of: 1:1, 3:2, 5:3, 2:1 or 3:1, when the weft binder yarns are included, and a pair of weft binder yarns counted as one machine side layer weft yarn.

Preferably, the ratio of the number of paper side layer warp yarns to the number of machine side layer warp yarns is 1:1. Alternatively, the ratio of the number of paper side layer warps to the number of machine side layer warps is 2:1.

Both the paper side layer and the machine side layer may be woven according any known weave design which would be acceptable for the intended use of the fabric, with the proviso that the paper side layer must be woven according to a design which provides for an internal warp float length of at least 2, and desirably it is at least 3 or more, since it is then possible to find more acceptable interweaving locations for the weft binder yarns.

Preferably, the fabrics of this invention have a 5/1 broken twill paper side layer weave which provides for a paper side layer warp internal float length of five yarns, and a 2/1 twill machine side layer design.

Figure 1:
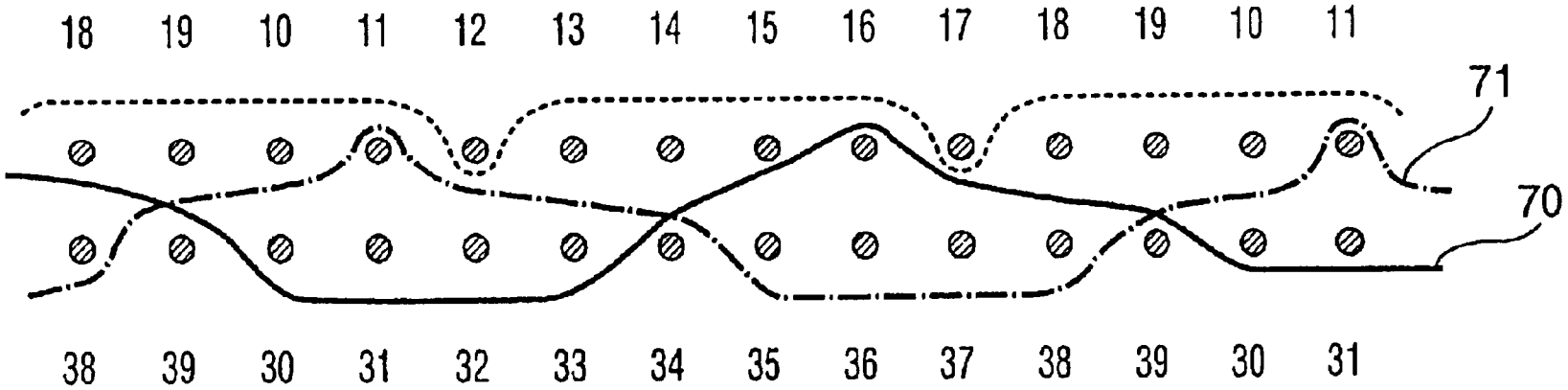
FIG. 1 is a weft profile for a first fabric according to this invention.

In all of the weft and warp profiles the paper side surface of the forming fabric is at the top, the machine side surface is at the bottom, and the cut yarns are shown as shaded circles. In the weft profiles, the paper side layer weft is shown dotted, and the machine side layer weft binder yarn pair as one solid and the other chain-dotted. In the warp profiles, the paper side layer warp is shown solid, and the machine side layer warp is shown dotted.

The same numbers are used for the warps and wefts within each set of three related figures. Paper side layer warp yarns are numbered from 10 to 29, machine side layer warp yarns from 30 to 49, paper side layer weft yarns are numbered from 50 to 69, and machine side layer weft yarns from 70 to 89, in each case as required.

In determining warp yarn ratios between each of the layers, every warp is counted for each layer. In determining weft yarn ratios, every machine side layer weft binder yarn pair is counted as one weft. The ratio is always given as paper side layer:machine side layer.

In the weave diagrams, the left section is the paper side layer design, and the right section is the machine side layer design. The warps for each layer are numbered from left to right in two sets. The weft for both layers are numbered down the left side only; each member of a machine side layer weft binder yarn pair is given a separate number (i.e in FIG. 3 weft 70 and 71 are the two members of a pair). In the woven fabric the paper side layer weft will be physically located more or less above the machine side layer weft. A filled in square indicates where a weft passes under a warp within that layer. A circle in both sections indicates a location at which one member of a machine side layer weft binder yarn pair interweaves with a paper side layer warp yarn.

The eight fabrics shown in the Figures will now be discussed in turn.

Figure 2:
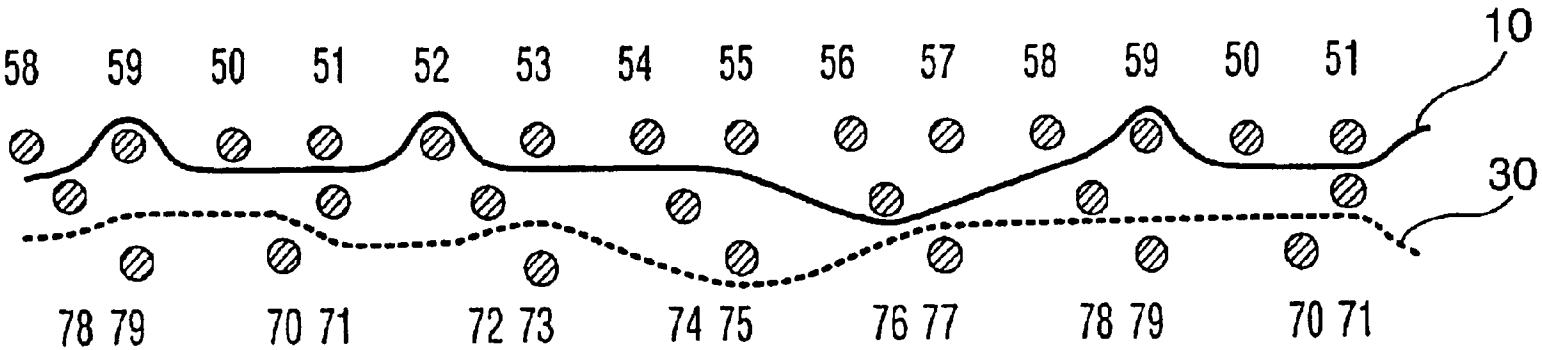
FIG. 2 is a warp profile for the fabric of FIG. 1.
Figure 3:
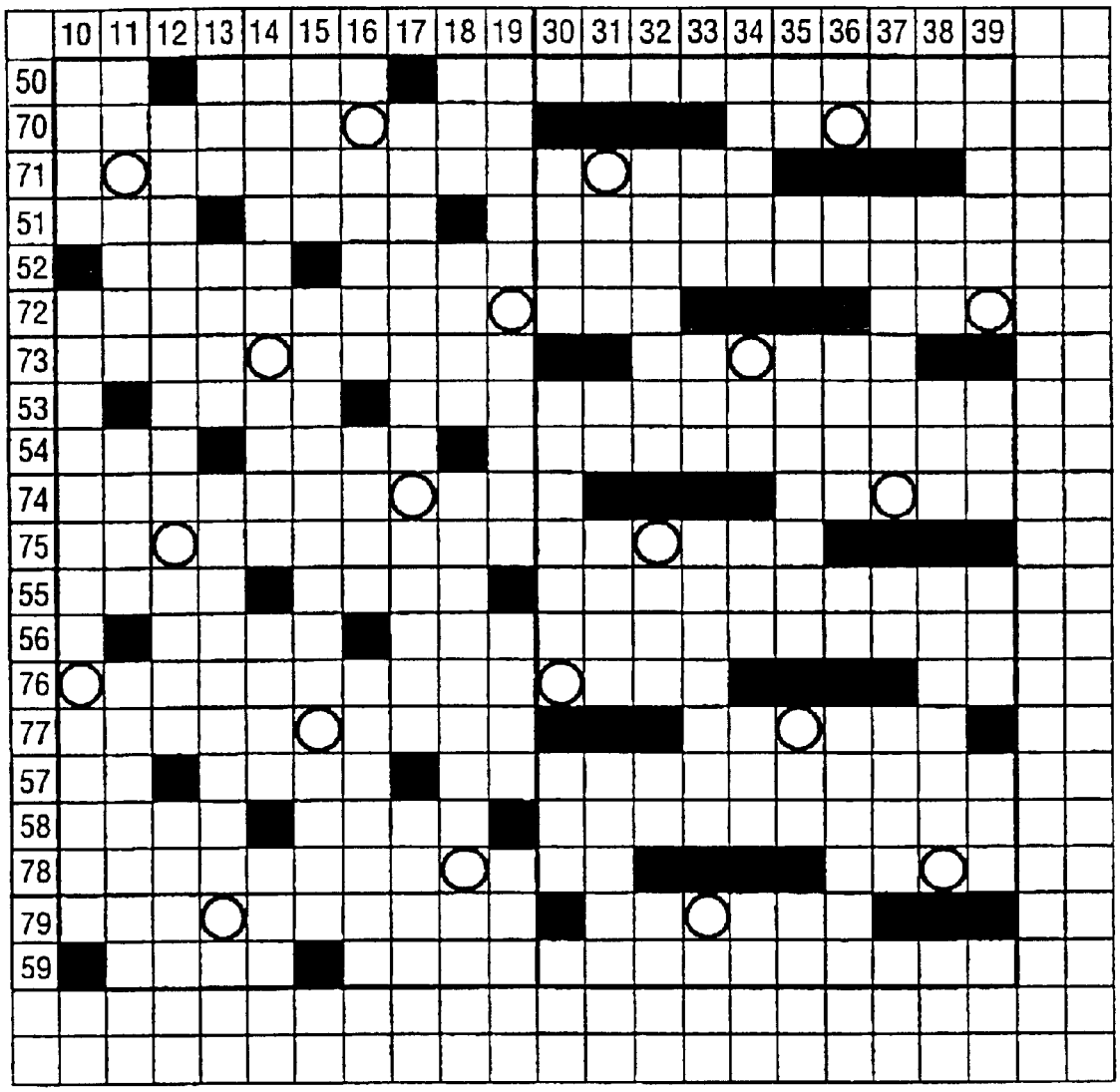
FIG. 3 is a weave diagram for the fabric of FIG. 1.

The fabric in FIGS. 1, 2 and 3 is woven in 20 sheds, using 10 sheds for each of the layers. The paper side layer is a 4/1 broken twill, and the machine side layer is also a 4/1 broken twill. All of the machine side layer weft are used in pairs as weft binder yarns; there are no other "ordinary" machine side layer weft yarns. The warp ratio is 1:1, and the weft ratio is 2:1.

Inspection of FIGS. 1 and 3 shows that the machine side layer broken twill weave used provides a long internal weft binder yarn float, and that the interweaving point is as near to the middle of the binder weft yarn float as possible: for example, weft 70 floats over warps 34–39, and interweaves with warp 16 above warp 36. It also shows that the paths occupied by the two members of each weft binder pair are the same, and thus the segment lengths occupied by each member of the pair in the machine side layer weft path are equal. Inspection of FIGS. 2 and 3 shows that the broken twill weave used provides a lengthy exposed internal paper side layer warp float, and that the interweaving point is close to the midpoint of this float: warp 10 floats under wefts 53–58, and interweaves with weft 76 adjacent to weft 56.

Figure 4:
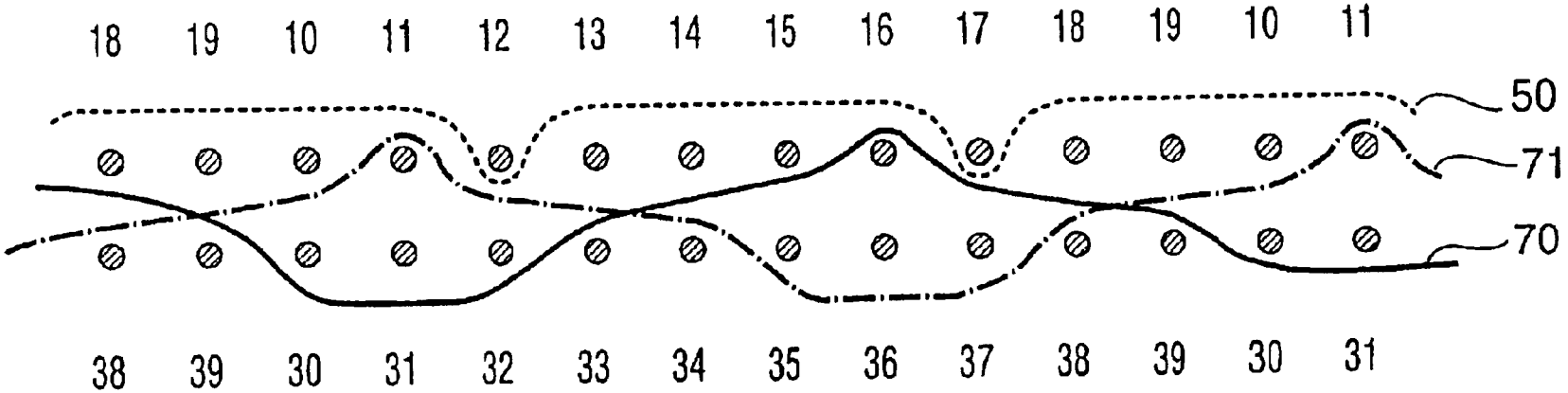
FIG. 4 is a weft profile for a second fabric according to this invention.
Figure 5:
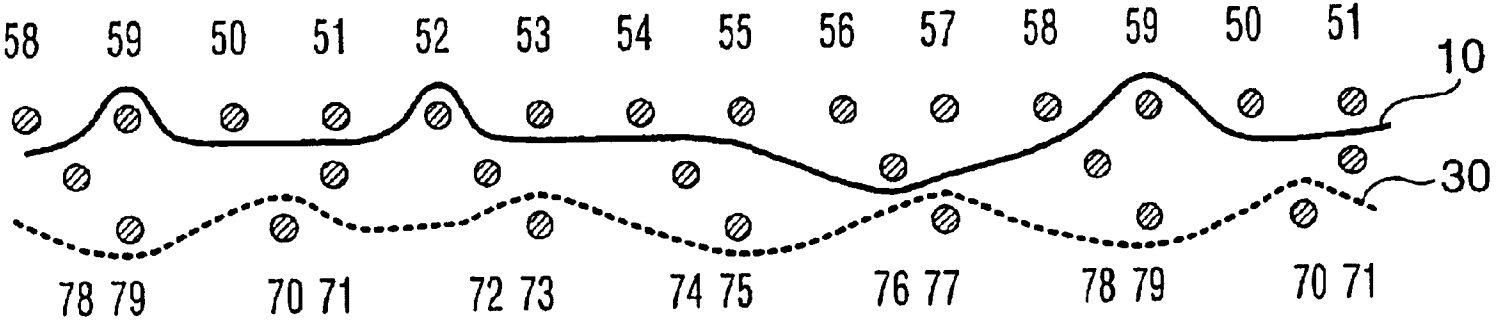
FIG. 5 is a warp profile for the fabric of FIG. 4.
Figure 6:
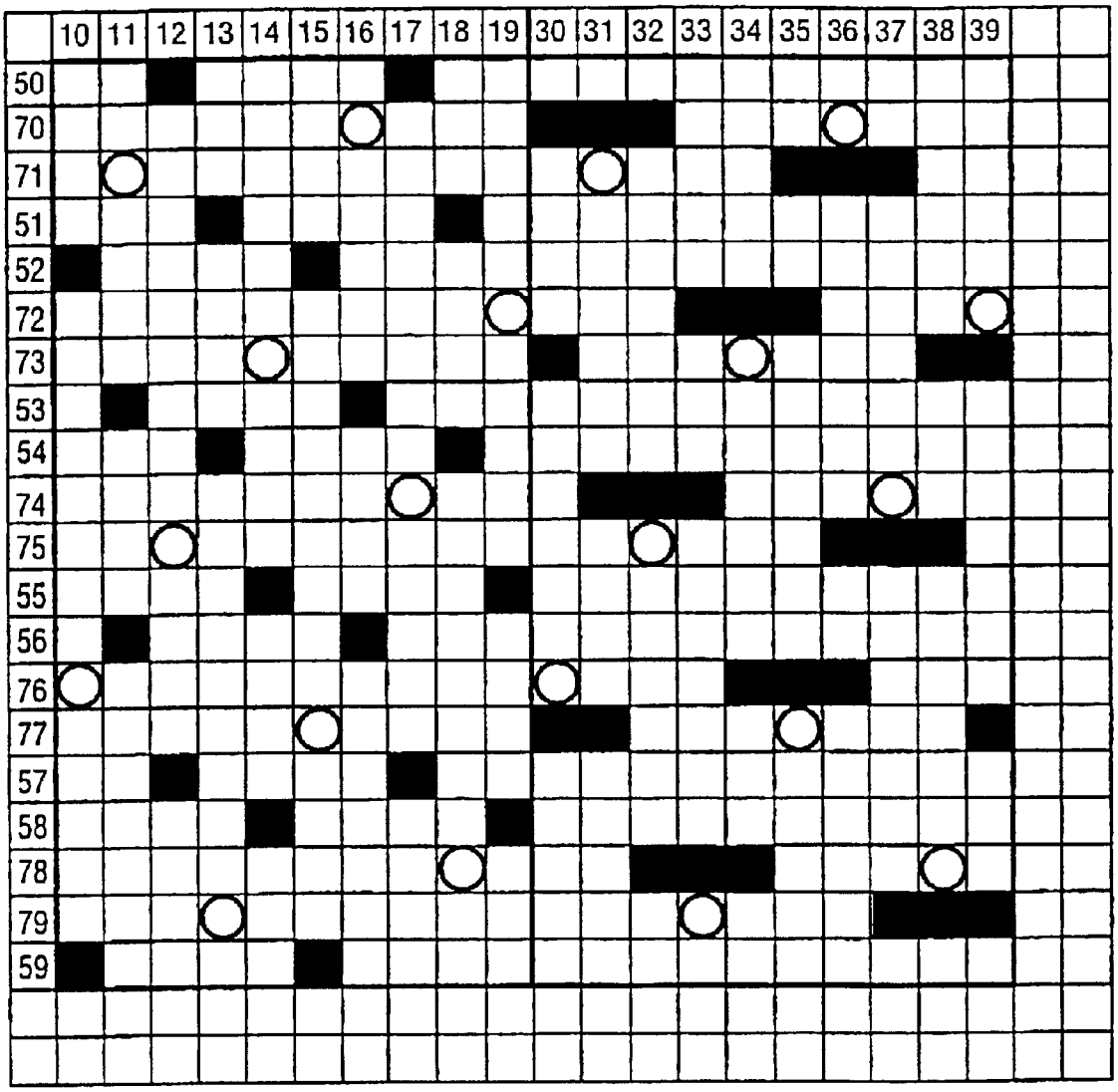
FIG. 6 is a weave diagram for the fabric of FIG. 4.

The fabric in FIGS. 4, 5 and 6 is woven in 20 sheds, using 10 sheds for each of the layers. The paper side layer is a 4/1 broken twill, and the machine side layer is a 3/2 twill. All of the machine side layer weft are used in pairs as weft binder yarns; there are no other "ordinary" machine side layer weft yarns. The warp ratio is 1:1, and the weft ratio is 2:1.

Inspection of FIGS. 4 and 6 shows that the machine side layer twill weave used provides a long internal weft binder yarn float, and that the interweaving point 15 as near to the middle of the binder weft yarn float as possible: for example, weft 70 floats over warps 33–39, and interweaves with warp 16 above warp 36. It also shows that the paths occupied by the two members of each weft binder pair are the same, and thus the segment lengths occupied by each member of the pair in the machine side layer weft path are equal. Inspection of FIGS. 5 and 6 shows that the broken twill weave used provides a lengthy exposed internal paper side layer warp float, and that the interweaving point is close to the midpoint of this float: warp 10 floats under wefts 53–58, and interweaves with weft 76 adjacent to weft 56.

Figure 7:
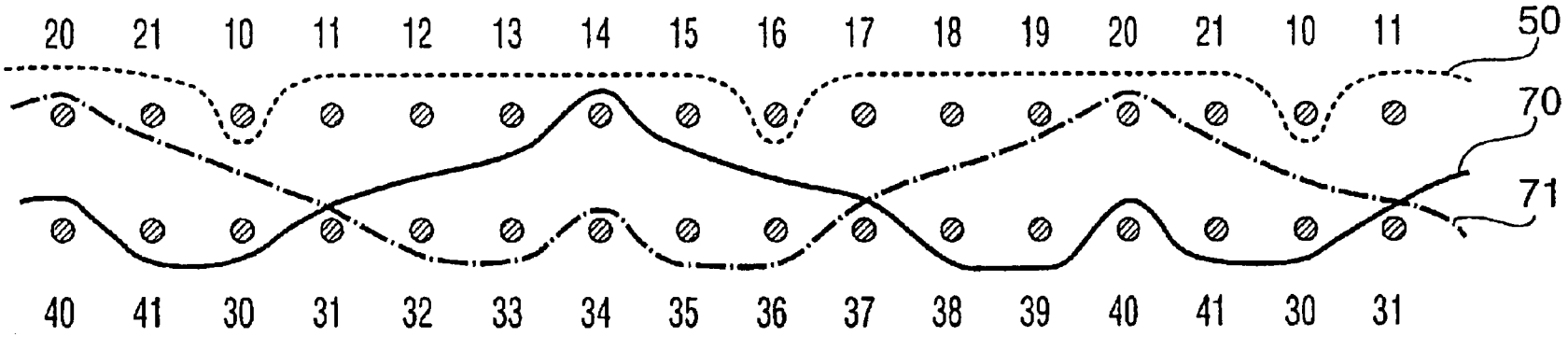
FIG. 7 is a weft profile for a third fabric according to this invention.
Figure 8:
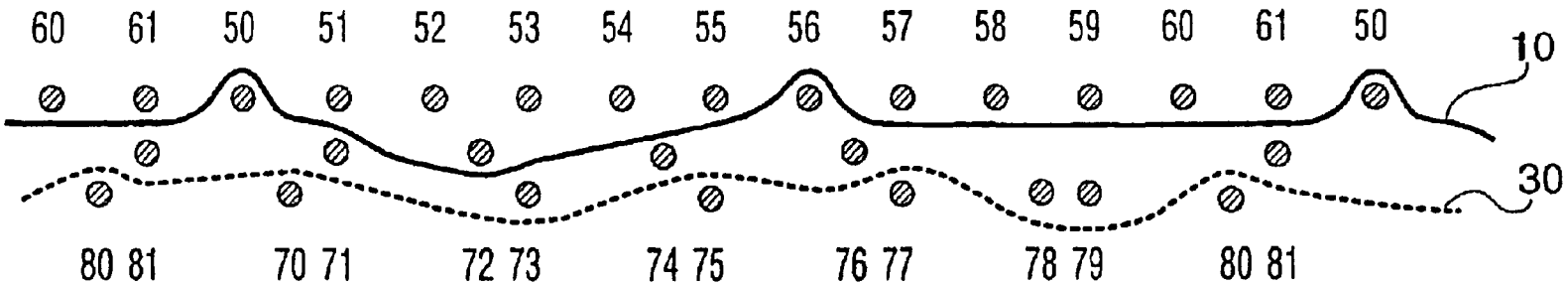
FIG. 8 is a warp profile for the fabric of FIG. 7.
Figure 9:
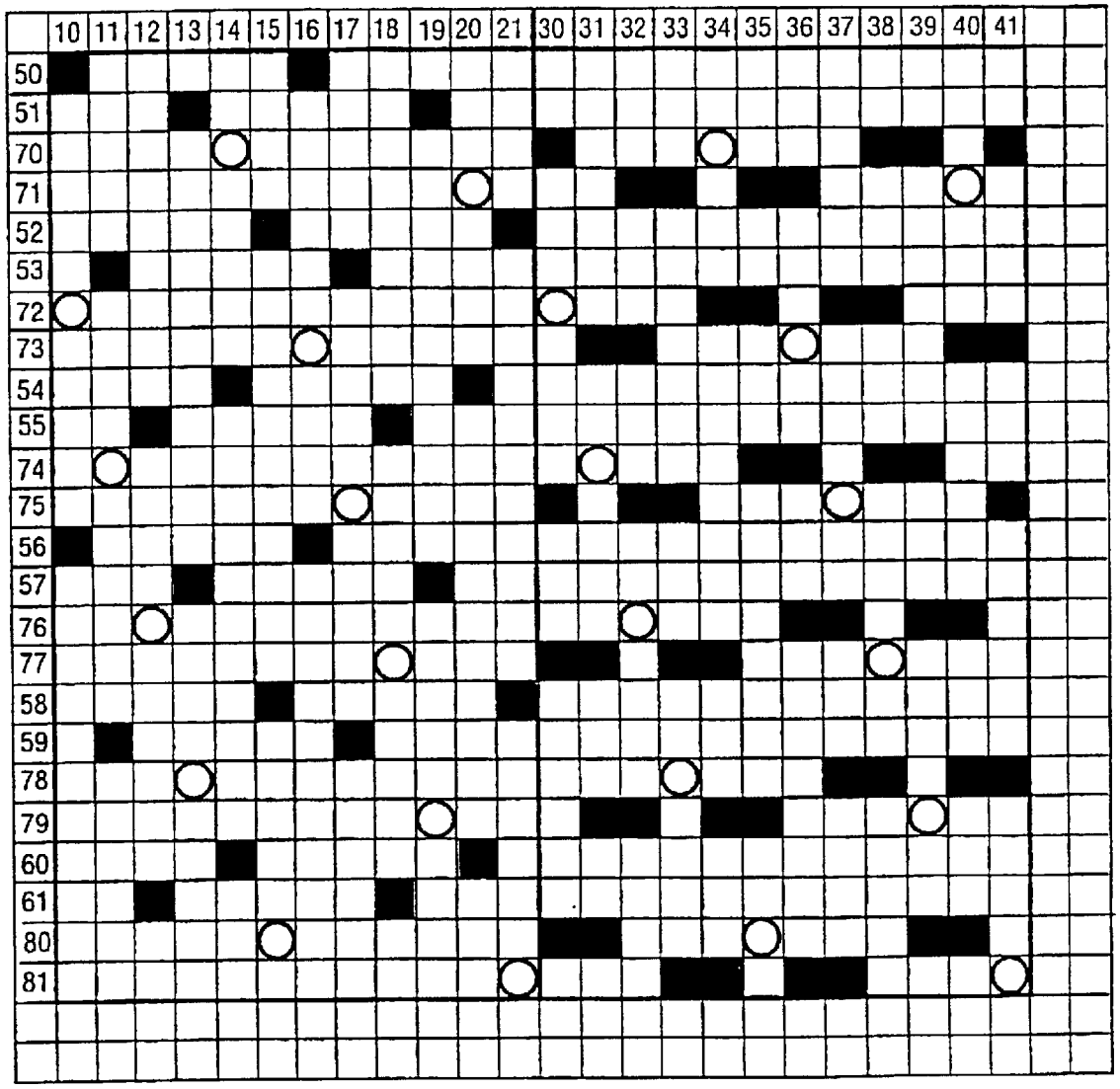
FIG. 9 is a weave diagram for the fabric of FIG. 7.

The fabric in FIGS. 7, 8 and 9 is woven in 24 sheds, using 12 sheds for each of the layers. The paper side layer is a 5/1 broken twill, and the machine side layer is a 4/2 twill. All of the machine side layer weft are used in pairs as weft binder yarns; there are no other "ordinary" machine side layer weft yarns. The warp ratio is 1:1, and the weft ratio is 2:1.

Inspection of FIGS. 7 and 9 shows that the machine side layer twill weave used provides a long internal weft binder yarn float, and that the interweaving point is as near to the middle of the binder weft yarn float as possible: for example, weft 70 floats over warps 31–37, and interweaves with warp 14 above warp 34. It also shows that the paths occupied by the two members of each weft binder pair are the same, and thus the segment lengths occupied by each member of the pair in the machine side layer weft path are equal. Inspection of FIGS. 8 and 9 shows that the broken twill weave used provides a lengthy exposed internal paper side layer warp float, and that the interweaving point is close to the midpoint of this float: warp 10 floats under wefts 51–55, and interweaves with weft 72 adjacent to weft 53.

Figure 10:
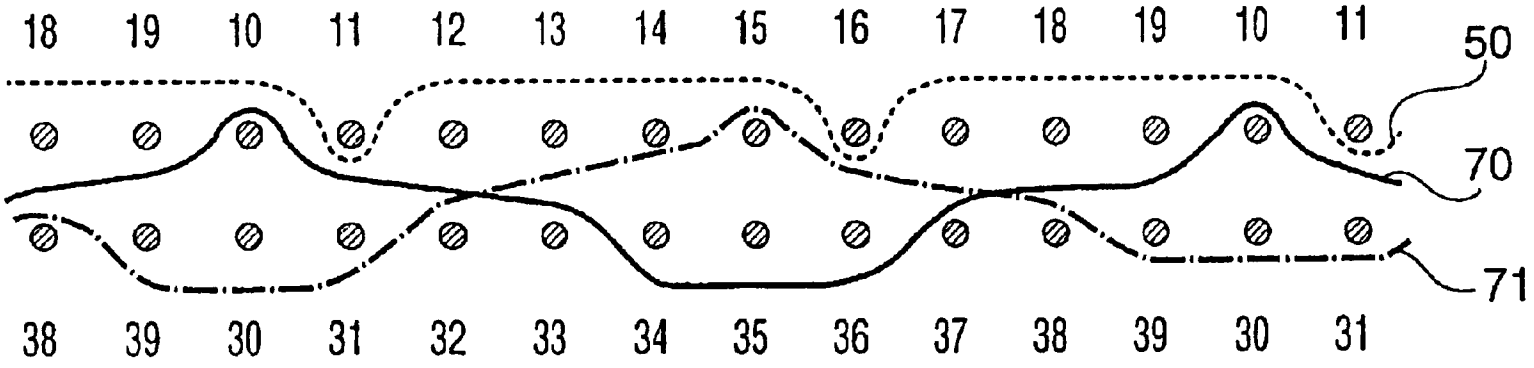
FIG. 10 is a weft profile for a fourth fabric according to this invention.
Figure 11:
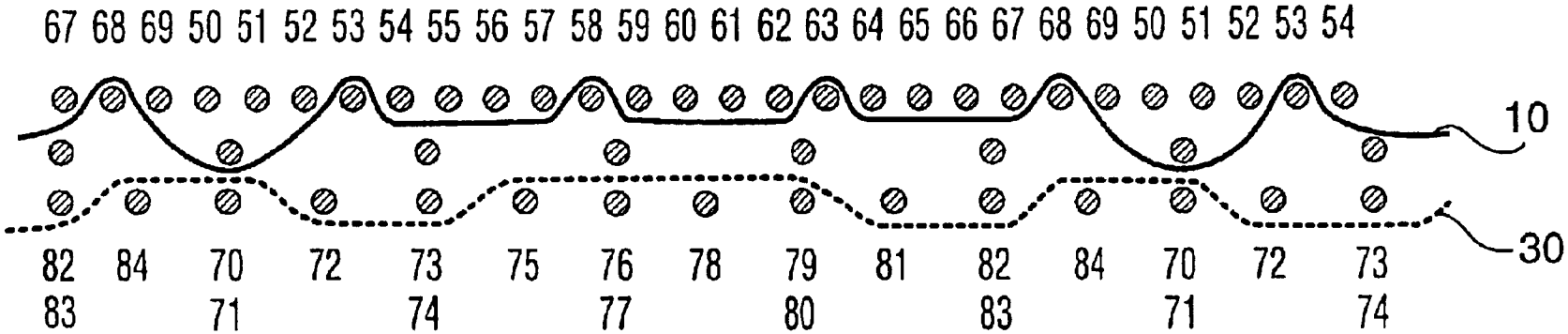
FIG. 11 is a warp profile for the fabric of FIG. 10.
Figure 12:
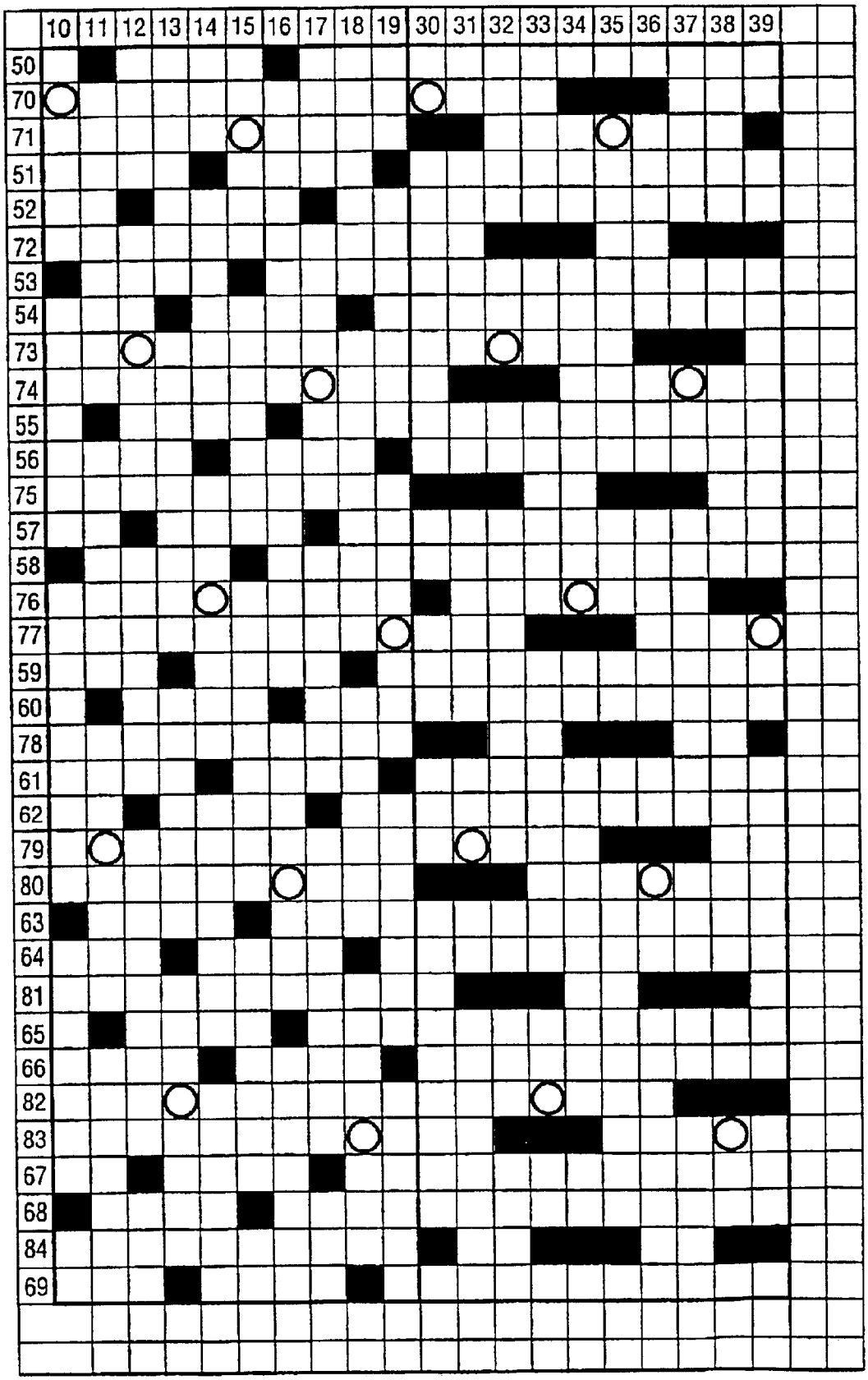
FIG. 12 is a weave diagram for the fabric of FIG. 10.

The fabric in FIGS. 10, 11 and 12 is woven in 20 sheds, using 10 sheds for each of the layers. The paper side layer is a 4/1 twill, and the machine side layer is a 3/2 twill. Not all of the machine side layer weft are used in pairs as weft binder yarns; there is one non-binding weft(machine side layer wefts 72, 75, 78, 81, and 84) between each pair of weft binder yarns. The warp ratio is 1:1, and the weft ratio is 2:1.

Inspection of FIGS. 10 and 12 shows that the machine side layer twill weave used provides a long internal weft binder yarn float, and that the interweaving point is as near to the middle of the binder weft yarn float as possible: for example, weft 71 floats over warps 32–30, and interweaves with warp 15 above warp 35. It also shows that the paths occupied by the two members of each weft binder pair are the same, and thus the segment lengths occupied by each member of the pair in the machine side layer weft path are equal. Inspection of FIGS. 11 and 12 shows that the twill weave used provides an exposed internal paper side layer warp float, and that the interweaving point is close to the midpoint of this float: warp 10 floats under wefts 69, 50, 51 and 52, and interweaves with weft 72 between wefts 50, 51.

Figure 13:
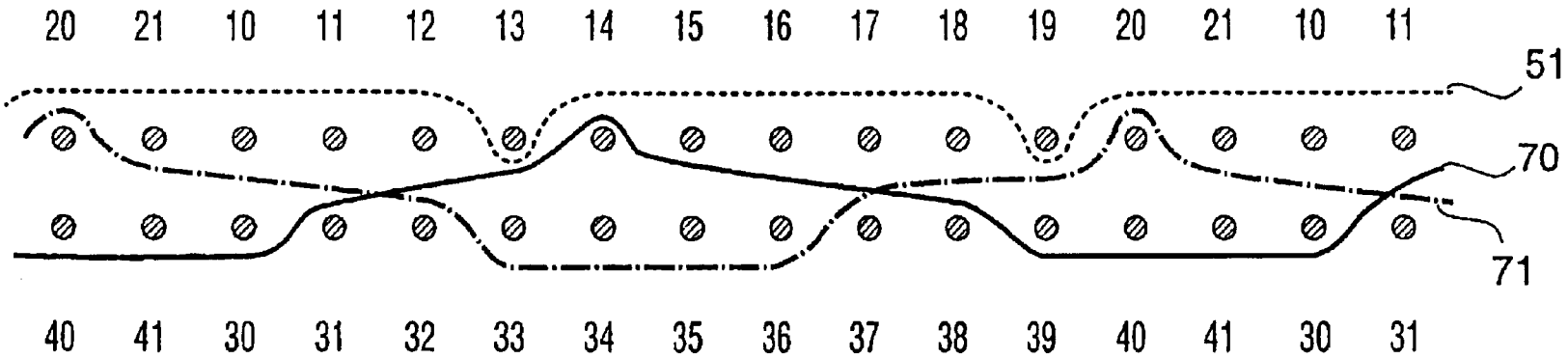
FIG. 13 is a weft profile for a fifth fabric according to this invention.
Figure 14:
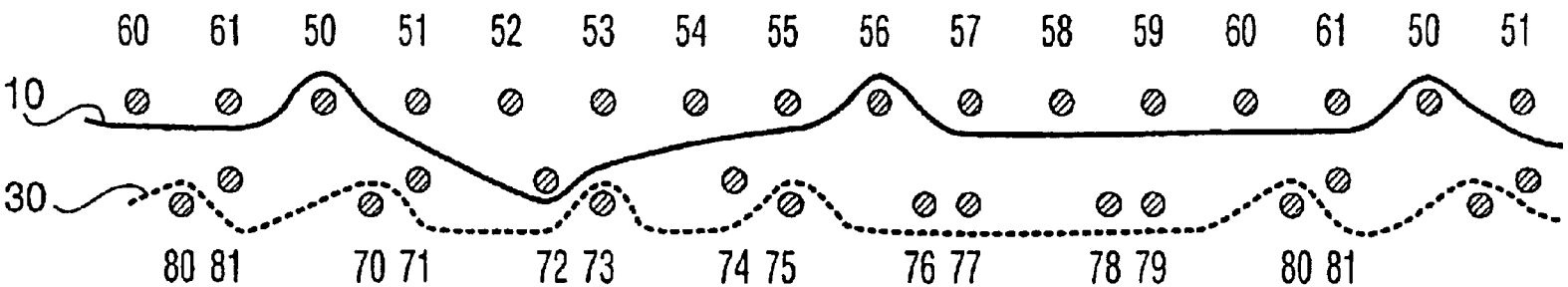
FIG. 14 is a warp profile for the fabric of FIG. 13.
Figure 15:
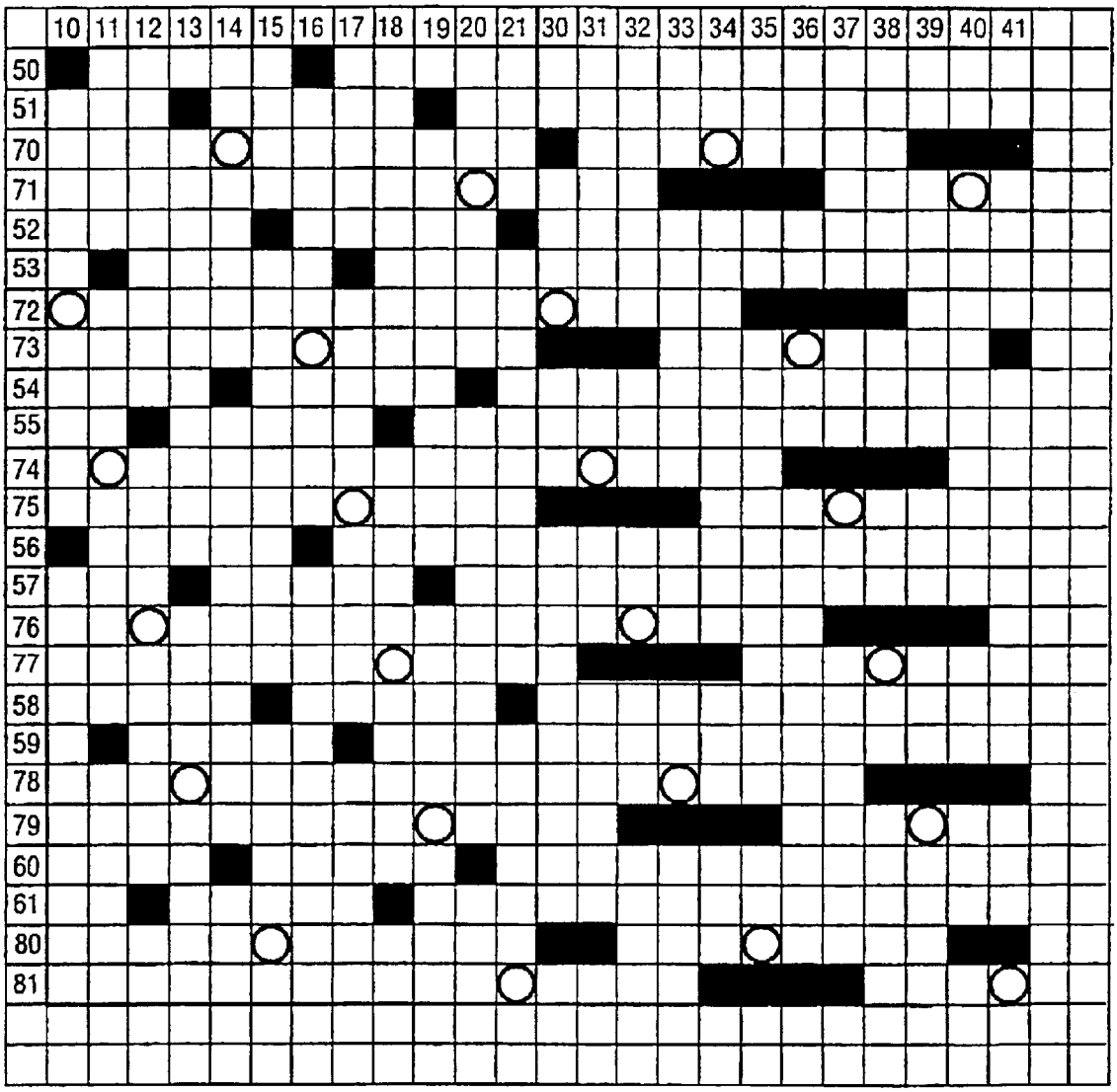
FIG. 15 is a weave diagram for the fabric of FIG. 13.

The fabric in FIGS. 13, 14 and 15 is woven in 24 sheds, using 12 sheds for each of the layers. The paper side layer is a 5/1 twill, and the machine side layer is a 4/2 broken twill. All of the machine side layer weft are used in pairs as weft binder yarns; there are no other "ordinary" machine side layer weft yarns. The warp ratio is 1:1, and the weft ratio is 2:1.

Inspection of FIGS. 13 and 15 shows that the machine side layer broken twill weave used provides a long internal weft binder yarn float, and that the interweaving point is as near to the middle of the binder weft yarn float as possible: for example, weft 70 floats over warps 31–38, and interweaves with warp 14 above warp 34. It also shows that the paths occupied by the two members of each weft binder pair are the same, and thus the segment lengths occupied by each member of the pair in the machine side layer weft path are equal. Inspection of FIGS. 14 and 15 shows that the twill weave used provides a lengthy exposed internal paper side layer warp float, and that the interweaving point is close to the midpoint of this float: warp 10 floats under wefts 51–55, and interweaves with weft 72 adjacent to weft 53.

Figure 16:
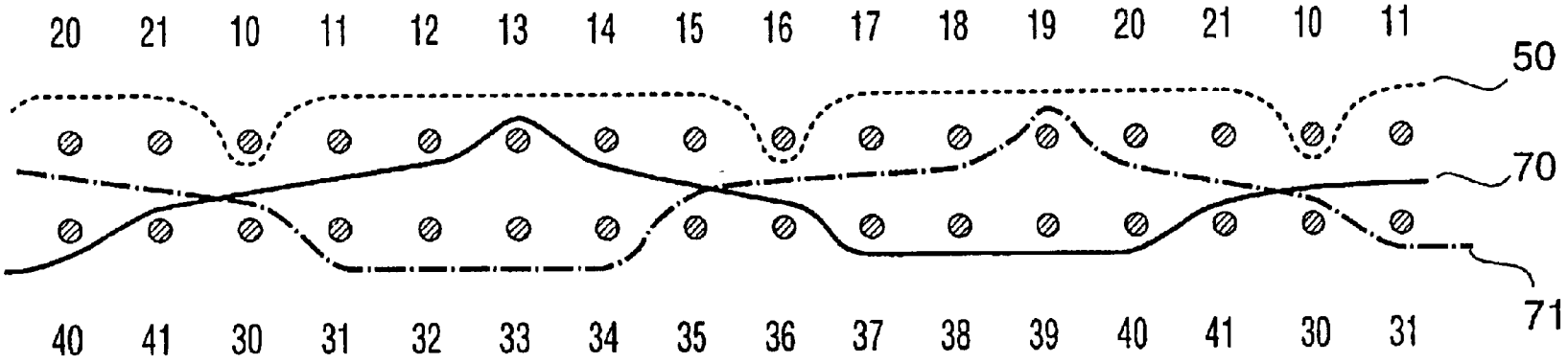
FIG. 16 is a weft profile for a sixth fabric according to this invention.
Figure 17:
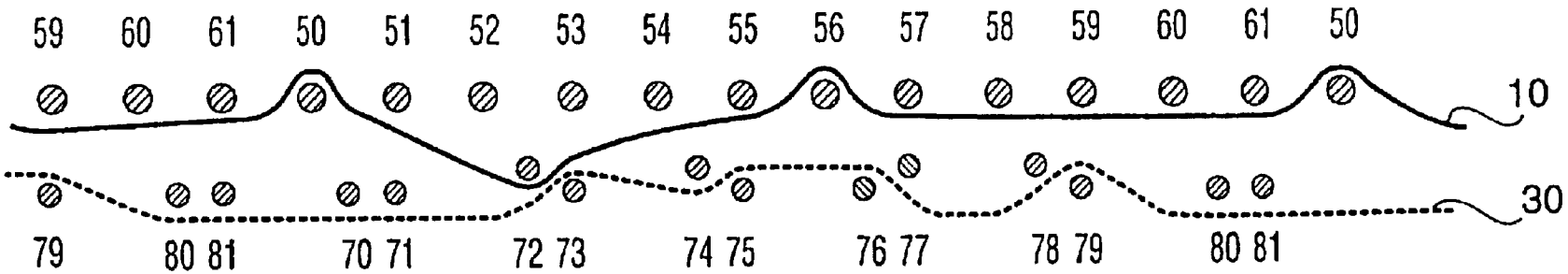
FIG. 17 is a warp profile for the fabric of FIG. 16.
Figure 18:
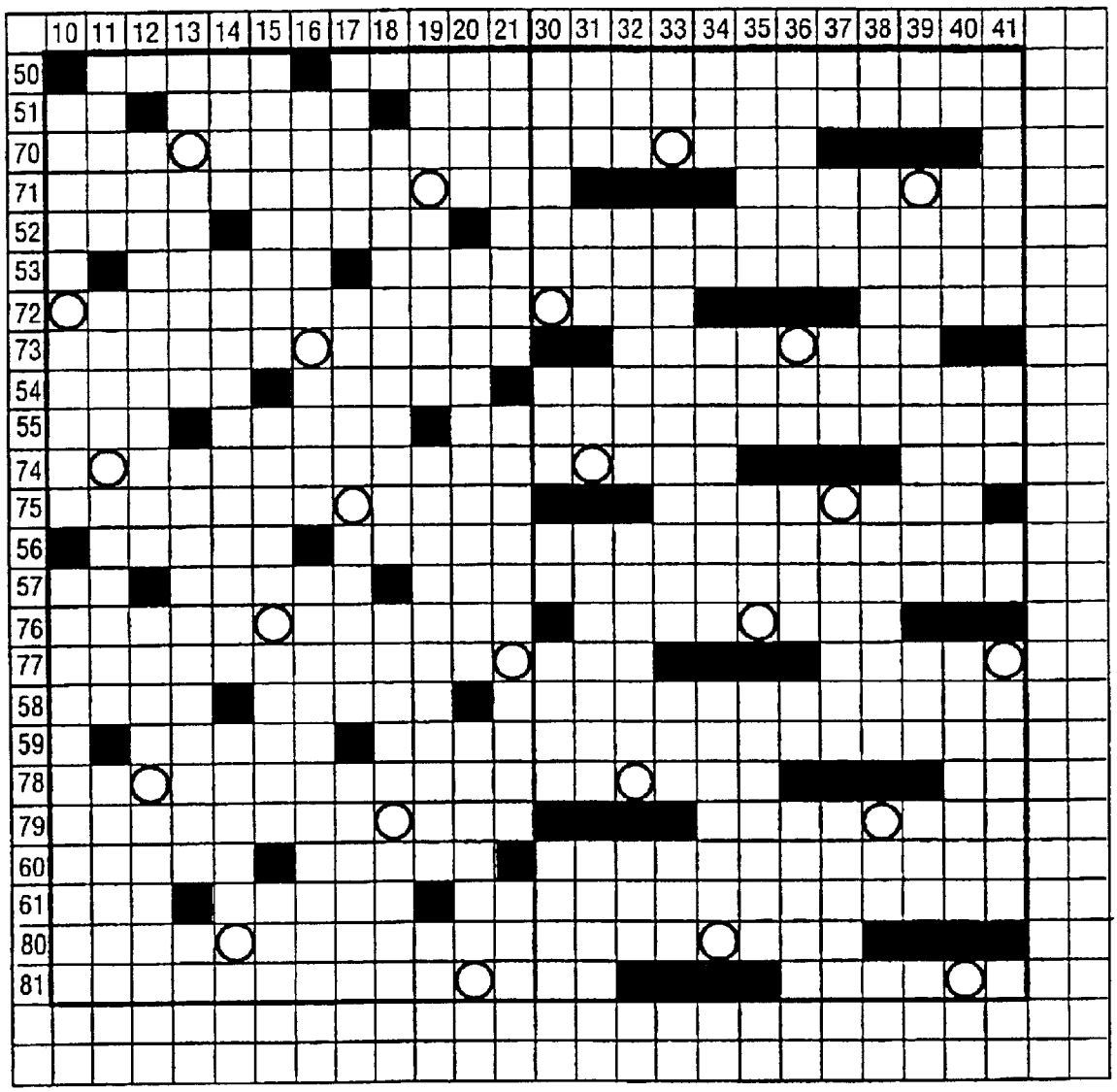
FIG. 18 is a weave diagram for the fabric of FIG. 16.

The fabric in FIGS. 16, 17 and 18 is woven in 24 sheds, using 12 sheds for each of the layers. The paper side layer is a 5/1 broken twill, and the machine side layer is a 4/2 broken twill. All of the machine side layer weft are used in pairs as weft binder yarns; there are no other "ordinary" machine side layer weft yarns. The warp ratio is 1:1, and the weft ratio is 2:1.

Inspection of FIGS. 16 and 18 shows that the machine side layer twill weave used provides a long internal weft binder yarn float, and that the interweaving point is as near to the middle of the binder weft yarn float as possible: for example, weft 70 floats over warps 41 and 30–36, and interweaves with warp 13 above warp 33. It also shows that the paths occupied by the two members of each weft binder pair are the same, and thus the segment lengths occupied by each member of the pair in the machine side layer weft path are equal. Inspection of FIGS. 17 and 18 shows that the broken twill weave used provides a lengthy exposed internal paper side layer warp float, and that the interweaving point is close to the midpoint of this float: warp 10 floats under wefts 51–55, and interweaves with weft 72 adjacent to weft 53.

Figure 19:
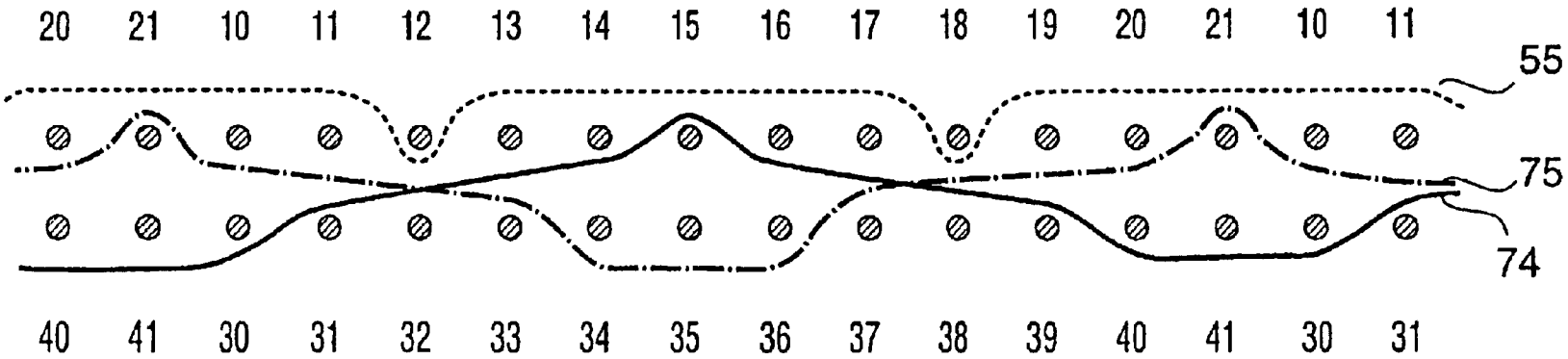
FIG. 19 is a weft profile for a seventh fabric according to this invention.
Figure 20:
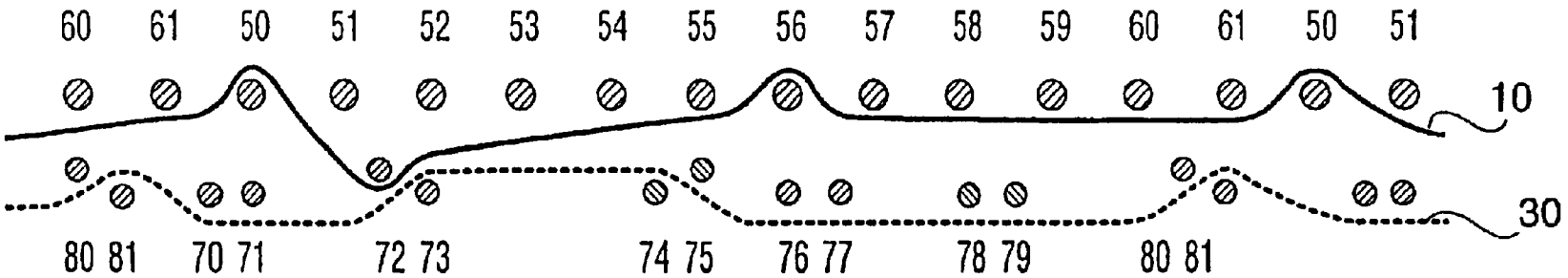
FIG. 20 is a warp profile for the fabric of FIG. 19.
Figure 21:
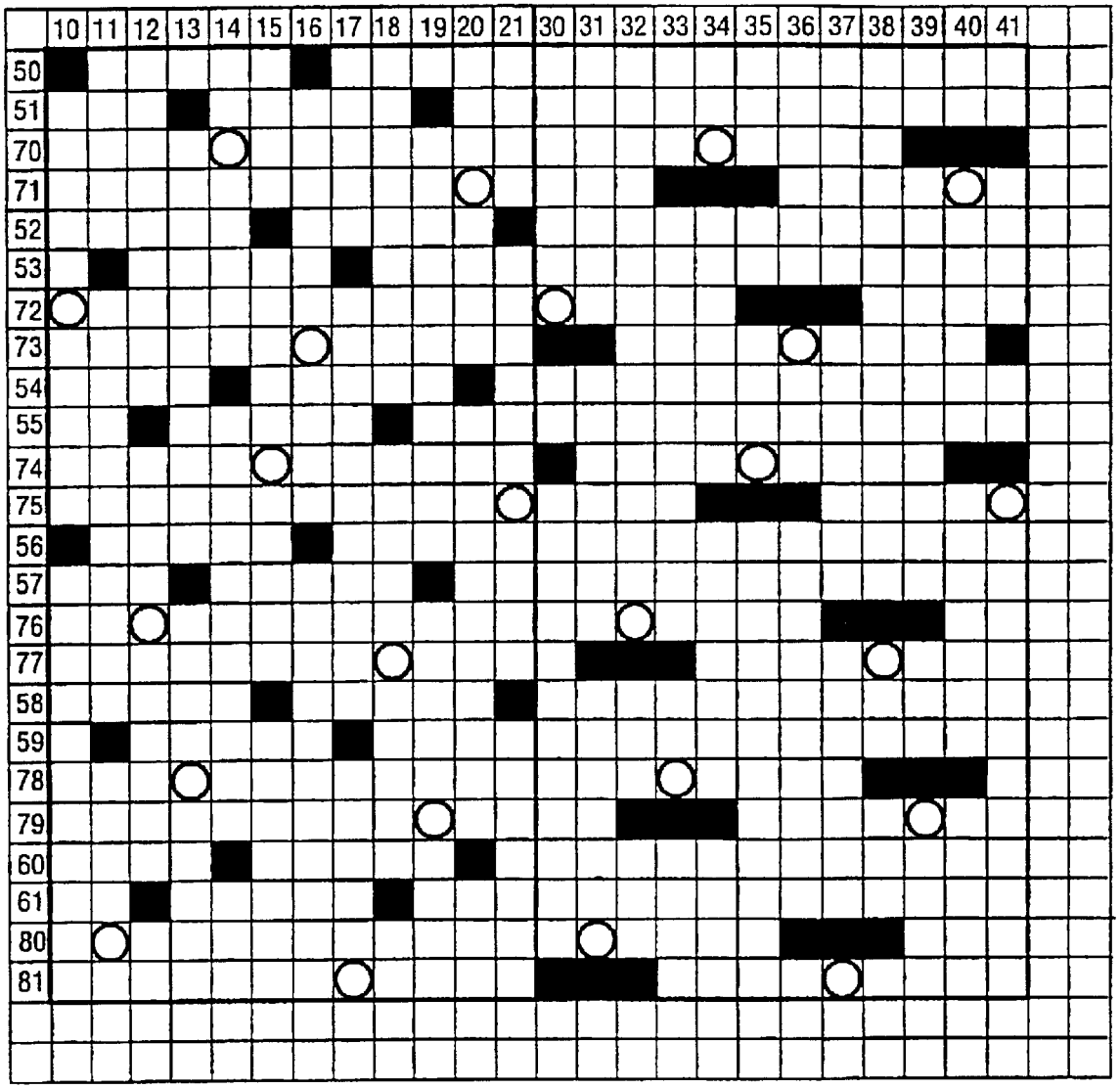
FIG. 21 is a weave diagram for the fabric of FIG. 19.

The fabric in FIGS. 19, 20 and 21 is woven in 24 sheds, using 12 sheds for each of the layers. The paper side layer is a 5/1 twill, and the machine side layer is a 3/3 broken twill. All of the machine side layer weft are used in pairs as weft binder yarns; there are no other "ordinary" machine side layer weft yarns. The warp ratio is 1:1, and the weft ratio is 2:1.

Inspection of FIGS. 19 and 21 shows that the machine side layer twill weave used provides a long internal weft binder yarn float, and that the interweaving point is as near to the middle of the binder weft yarn float as possible: for example, weft 74 floats over warps 31–39, and interweaves with warp 15 above warp 35. It also shows that the paths occupied by the two members of each weft binder pair are the same, and thus the segment lengths occupied by each member of the pair in the machine side layer weft path are equal. Inspection of FIGS. 20 and 21 shows that the twill weave used provides a lengthy exposed internal paper side layer warp float, and that the interweaving point is close to the midpoint of this float: warp 10 floats under wefts 51–55, and interweaves with weft 72 adjacent to weft 53.

Figure 22:
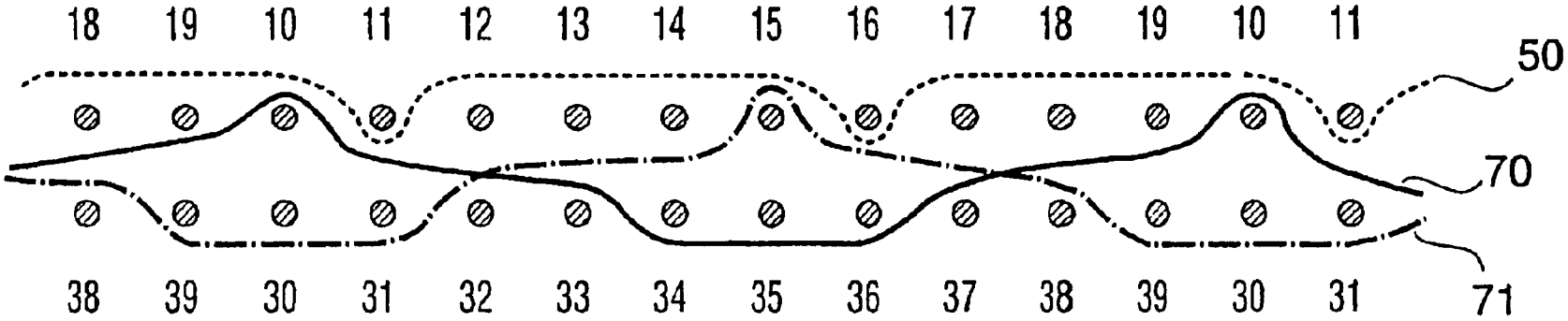
FIG. 22 is a weft profile for an eighth fabric according to this invention.
Figure 23:
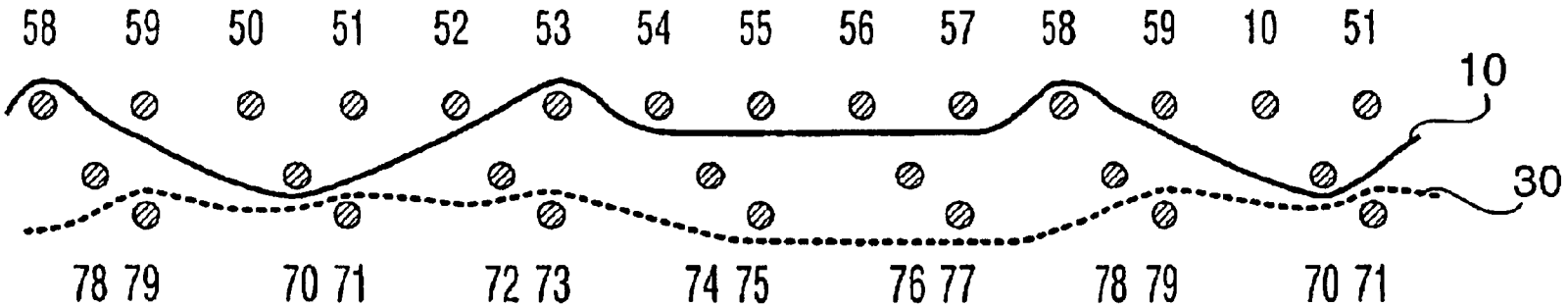
FIG. 23 is a warp profile for the fabric of FIG. 22.
Figure 24:
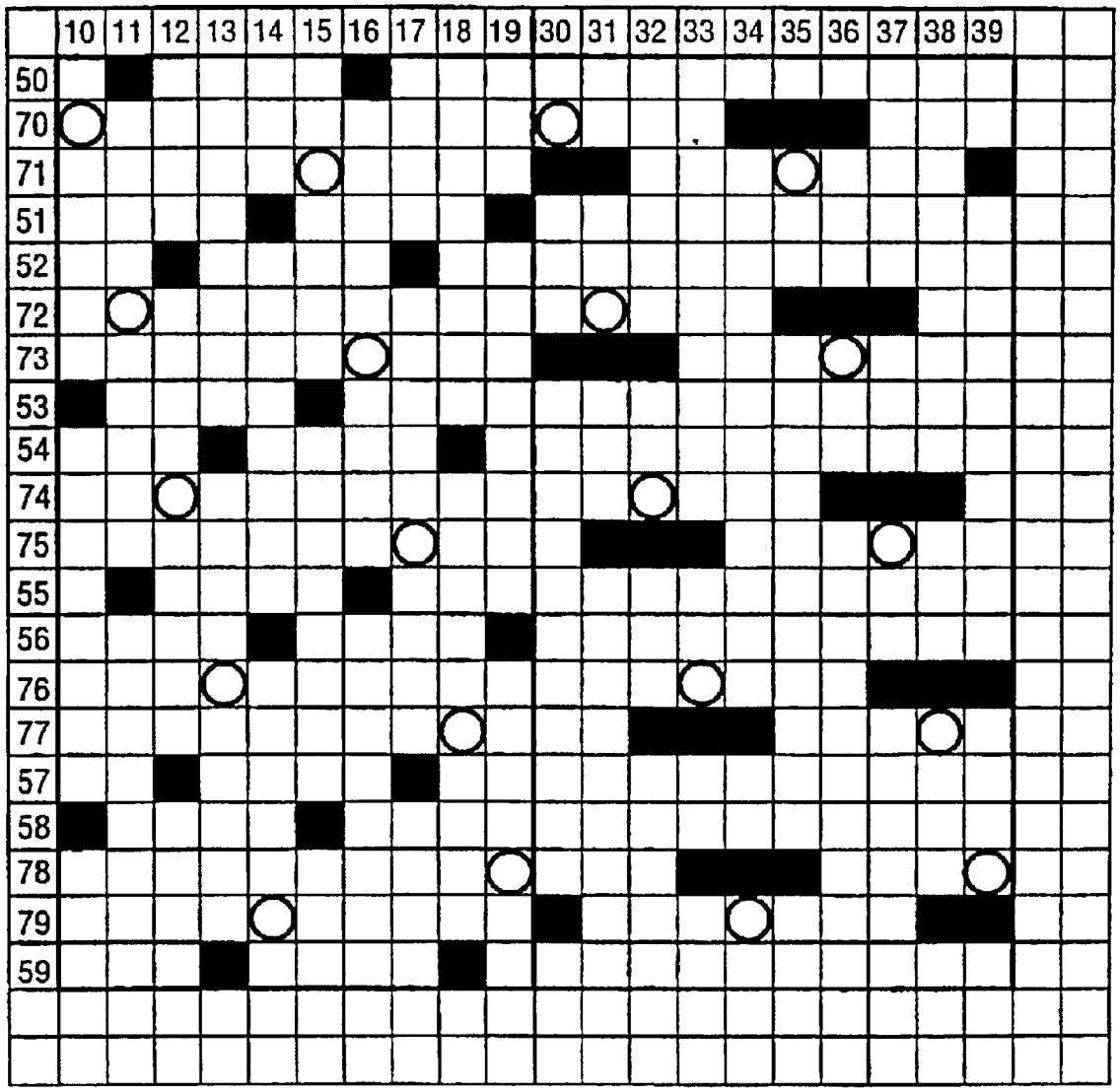
FIG. 24 is a weave diagram for the fabric of FIG. 22.

The fabric in FIGS. 22, 23 and 24 is woven in 20 sheds, using 10 sheds for each of the layers. The paper side layer is a 4/1 broken twill, and the machine side layer is a 3/2 twill. All of the machine side layer weft are used in pairs as weft binder yarns; there are no other "ordinary" machine side layer weft yarns. The warp ratio is 1:1, and the weft ratio is 2:1.

Inspection of FIGS. 22 and 24 shows that the machine side layer twill weave used provides a long internal weft binder yarn float, and that the interweaving point is as near to the middle of the binder weft yarn float as possible: for example, weft 71 floats over warps 32–38, and interweaves above with warp 15 above warp 35. It also shows that the paths occupied by the two members of each weft binder pair are the same, and thus the segment lengths occupied by each member of the pair in the machine side layer weft path are equal. Inspection of FIGS. 23 and 24 shows that the broken twill weave used provides an exposed internal paper side layer warp float, and that the interweaving point is close to the midpoint of this float: warp 10 floats under wefts 59 and 50–52, and interweaves with weft 70 between wefts 51, 52.

It is noted above that in the prior art fabrics using paper side layer weft binder yarns all of the available interlacing points between each weft binder yarn pair member and a machine side layer warp are utilised. In the fabrics of this invention, it has been found that it is not necessary that all of the available interweaving locations between the machine side layer weft binder yarns and the paper side layer warp yarn internal floats be utilized. Some interweaving points can be omitted in alternating repeats of the weave designs chosen for the paper side layer and the machine side layer. Although the weave designs chosen for each of the two layers are not affected by such an omission, and thus appear to continue unchanged, such an alternating omission has the effect of doubling the machine direction length of the weave pattern repeat for the forming fabric.

The warp and weft yarns used in the forming fabrics of this invention will generally be thermoplastic monofilaments. Both the cross sectional shape, filament dimensions, warp fill, weft fill, and paper side surface open area will be chosen to provide the properties required in the fabric. Fabrics according to this invention have been found to be particularly suitable for tissue grades of paper products.

The forming fabrics of this invention show improved machine side layer properties, for example improved machine side layer resistance to wear, and improved forming fabric properties, for example cross-machine direction stiffness and overall stability. Fabric stiffness and stability are related to the number of interweaving locations, and both increase as the number of locations increases. Improved cross machine stiffness is of relevance when the fabric is subjected to relatively high tension on the forming section, since a stiffer fabric resists narrowing better. The forming fabrics of this invention also permit the use of relatively longer paper side layer weft floats without unduly detracting from fabric stiffness or stability.

The long paper side layer floats also provide improved cross-machine direction support for paper making fibres orientated in the machine direction, without hindering drainage of the incipient paper product web through the forming fabric. This is useful in the manufacture of some grades of product, such as tissue and packaging, where some wire mark in the products is acceptable, and is in fact beneficial in some products as it increases sheet bulk. The 5/1 broken twill paper side layer weave design combined with a 2/1 twill machine side layer has been found to be particularly useful, due to its wear resistance.

What is claimed is:

1. A papermaker's forming fabric comprising in combination a paper side layer including a first set of warp and weft yarns interwoven according to a first pattern which provides for internal floats of the paper side layer warp yarns, a machine side layer including a second set of warp and weft yarns, in which the weft yarns include weft binder yarn pairs, interwoven according to a second pattern which provides for internal floats of the machine side layer weft binder yarns, wherein within the fabric weave pattern repeat:

(i) the weft binder yarn pairs together occupy successive segments of an unbroken weft path within the machine side layer;

(ii) at least some of the machine side layer weft binder yarn internal floats interweave with paper side layer internal warp yarn floats;

(iii) there is zero, one, two or three machine side layer weft yarns between each pair of binder yarns; and (iv) the paper side layer warp yarn internal float length is at least 2.

2. A fabric according to claim 1 wherein the segments of the weft binder yarn unbroken weft path occupied by each member in succession are the same length.

3. A fabric according to claim 1 wherein the segments of the weft binder yarn unbroken weft path occupied by each member in succession are not the same length.

4. A forming fabric according to claim 1 wherein each weft binder yarn interlaces at or near to the midpoint of an internal paper side layer warp yarn float.

5. A forming fabric according to claim 1 wherein within the pattern repeat, each machine side layer weft binder yarn interweaves at least once with a paper side layer warp yarn.

6. A forming fabric according to claim 1 wherein the path occupied by each weft binder yarn, as it passes from interlacing with the machine side layer warp yarns in a segment of the machine side layer weft yarn path to interweave with a paper side layer warp yarn internal float and returns to interlace with the machine side layer warp yarns in another segment of the machine side layer weft yarn path, is more or less symmetrical about the interweaving point.

7. A forming fabric according to claim 1 wherein the paper side layer warp yarn internal float length is at least three.

8. A forming fabric according to claim 1 wherein the paper side layer warp yarn float length is at least four.

9. A forming fabric according to claim 1 wherein the paper side layer is woven according to a weave design chosen from the group consisting of: a 2/1 twill, a 2/1 broken twill, a 2/1 satin, a 2/2 basket weave, a 2/2 twill, a 3/1 twill, a 3/1 broken twill, a 3/1 satin, a 3/2 twill, a 3/2 satin, a 4/1 twill, a 4/1 broken twill, a 4/1 satin, a 5/1 twill, a 5/1 broken twill, and a 5/1 satin.

10. A forming fabric according to claim 1 wherein the machine side layer is woven according to a weave design chosen from the group consisting of: a plain weave, a 2/1 twill, a 2/1 broken twill, a 2/1 satin, a 2/2 basket weave, a 3/1 twill, a 3/1 broken twill, a 3/1 satin, a 3/2 twill, a 3/2 satin, a 4/1 twill, a 4/1 broken twill, a 4/1 satin, a 5/1 twill, a 5/1 broken twill, a 5/1 satin, a 6/1/ twill, a 6/1 broken twill, a 6/1 satin, and an N×2N design as disclosed by Barrett in U.S. Pat. No. 5,544,678.

11. A forming fabric according to claim 1 wherein the ratio of the number of paper side layer weft yarns to the number of machine side layer weft yarns is chosen from the group consisting of: 1:1, 3:2, 5:3, 2:1 or 3:1, when the weft binder yarns are included, and a pair of weft binder yarns counted as one paper side layer weft yarn.

12. A forming fabric according to claim 1 wherein in the machine side layer weave repeat pattern two pairs of weft binder yarns are separated by zero machine side layer weft yarn.

13. A forming fabric according to claim 1 wherein in the machine side layer weave repeat pattern two pairs of binder yarns are separated by one machine side layer weft yarns.

14. A forming fabric according to claim 1 wherein at at least one locus within the forming fabric pattern repeat a weft binder yarn internal exposed float is not interwoven with a paper side layer warp.

* * * * *